US008544566B2

(12) United States Patent
Mulligan

(10) Patent No.: US 8,544,566 B2
(45) Date of Patent: Oct. 1, 2013

(54) FLUID ACTUATED IMPACT TOOL WITH SOLID PISTON-STANDARD BIT ARRANGEMENT AND WATER SEAL

(75) Inventor: Michael Mulligan, West Sacramento, CA (US)

(73) Assignee: Eastern Drillers Manufacturing, Inc., Columbia, PA (US)

( * ) Notice: Subject to any disclaimer, the term of this patent is extended or adjusted under 35 U.S.C. 154(b) by 570 days.

(21) Appl. No.: 12/815,615

(22) Filed: Jun. 15, 2010

(65) Prior Publication Data

US 2011/0303464 A1 Dec. 15, 2011

(51) Int. Cl.
*E21B 4/14* (2006.01)
*E21B 10/36* (2006.01)

(52) U.S. Cl.
USPC ..... 175/296; 175/414; 173/91

(58) Field of Classification Search
USPC ..... 175/293, 296, 321, 414; 173/91, 173/17, 14, 13
See application file for complete search history.

(56) References Cited

U.S. PATENT DOCUMENTS 2,937,619 A * 5/1960 Kurt ..... 173/17
3,958,645 A 5/1976 Curington
4,030,554 A 6/1977 Kammerer, Jr. et al.
4,084,646 A 4/1978 Kurt
4,530,408 A 7/1985 Toutant
4,706,764 A 11/1987 Hughes
4,821,812 A 4/1989 Ditzig
5,301,758 A 4/1994 Jenne
5,337,837 A 8/1994 Wentworth et al.
5,465,797 A 11/1995 Wentworth et al.
5,603,383 A 2/1997 Wentworth et al.
5,680,904 A 10/1997 Patterson
5,944,117 A 8/1999 Burkholder et al.
6,386,301 B1 * 5/2002 Rear ..... 175/296

* cited by examiner

*Primary Examiner* — Shane Bomar
*Assistant Examiner* — Wei Wang
(74) *Attorney, Agent, or Firm* — Panitch Schwarze Belisario & Nadel LLP

(57) ABSTRACT

A fluid-actuated percussive impact tool includes a drill bit disposed partially within a casing for respective longitudinal movement between extended and retracted positions. A bearing having a bore is fixedly disposed within the casing. A piston is located in the chamber and a second end thereof is configured to selectively enter the bore of the bearing through the first end to impact the first end of the drill bit. At least one groove is formed in an exterior surface of the piston proximate the second end thereof. The tool has a sealed position when the drill bit is in the extended position wherein a water seal is formed between an interior surface of the bearing and a portion of the exterior surface of the piston between the first end of the piston and the first end of the at least one groove.

9 Claims, 4 Drawing Sheets

FLUID ACTUATED IMPACT TOOL WITH SOLID PISTON-STANDARD BIT ARRANGEMENT AND WATER SEAL

BACKGROUND OF THE INVENTION

Embodiments of the present invention relate to impact tools for use in drilling operations, and more particularly, to fluid actuated percussive drilling equipment such as used in rock drilling and similar operations.

Down hole well drilling, for oil, gas, or water, requires a specially designed drill apparatus, which can be used in applications where the diameter of the drill body is less than the drill bit diameter. The drill apparatus must provide high energy output, simplicity, and reliability in order to provide economical operation, and must also be able to withstand the abrasive environment as well as the continuous impact loading required for cutting through rock.

Pressurized fluid-actuated impact tools, and in particular pneumatic down-the-hole rock drills of this type, are generally known, as disclosed in U.S. Pat. No. 4,084,646, the disclosure of which is incorporated herein by reference. This patent discloses a drill having only a single moving part and all valving of the pressurized fluid is accomplished by interior and exterior porting on the piston and the casing. In such known drills, the moving part comprises a piston which strikes directly on the percussive bit. The known devices utilize a piston weighing between 45 and 50 pounds which is reciprocated at a frequency of approximately 1,500-1,800 blows per minute by pressurized air, generally provided at 250 to 350 psi. U.S. Pat. No. 5,944,117, the entire contents of which are incorporated by reference herein, also discloses a pressurized fluid-actuated impact tool.

Standard drill bits are conventionally utilized with pistons having internal ports. However, the ports make the piston more susceptible to damage from shock waves disbursed from the cut edges of the hole, causing fatigue and shortening the life of the drill. Solid pistons (i.e., pistons with no internal ports other than a central longitudinal bore) enable the shock waves to be disbursed evenly, but cannot be connected to a standard drill bit. An exhaust tube or foot valve is required to connect the bores of the piston and the drill bit. The foot valve is fragile and susceptible to breakage from stresses, water, and the like. It is therefore desirable to provide a fluid-actuated impact tool that can utilize a solid piston with a standard drill bit.

Further, when the drill bit is located in the hole but is not operating, gravity pulls the drill bit and piston downward, opening a channel for the entrance of water (and all of the sediment and/or debris carried therewith) into the drill. It is therefore desirable to provide a seal within the drill when the drill is not operating to prevent the entrance of water therein to avoid damaging or compromising the tight tolerances of the components therein.

BRIEF SUMMARY OF THE INVENTION

Briefly stated, an embodiment of the present invention comprises a fluid-actuated percussive impact tool having a casing extending longitudinally between a first end and a second end, a back head disposed at the first end of the casing for connection to a pressurized fluid source, a distributor disposed in the casing at the first end thereof proximate to the back head, and a drill bit extending longitudinally between a first end and a second end. The first end of the drill bit is disposed within the casing proximate the second end of the casing and the second end of the drill bit is disposed outside of the casing proximate the second end of the casing. The drill bit and the casing are longitudinally movable with respect to each other between an extended position wherein the second end of the drill bit is furthest from the casing and a retracted position wherein the second end of the drill bit is directly adjacent the second end of the casing. A chamber within the casing is located between the distributor and the drill bit. A bearing extending longitudinally between a first end and a second end and having a bore extending therebetween is fixedly disposed within the casing proximate the second end of the casing. At least a portion of the first end of the drill bit is disposed within the bore proximate the second end of the bearing. A piston extending longitudinally between a first end and second end is located in the chamber for reciprocating longitudinal movement. The second end of the piston is configured to selectively enter the bore of the bearing through the first end of the bearing to impact the first end of the drill bit. At least one groove having a first end and a second end is formed in an exterior surface of the piston proximate the second end of the piston and extends partially along the piston toward the first end thereof. The tool has a sealed position when the drill bit is in the extended position wherein a water seal is formed between an interior surface of the bearing and a portion of the exterior surface of the piston between the first end of the piston and the first end of the at least one groove.

Another embodiment of the present invention comprises a fluid-actuated percussive impact tool having a casing extending longitudinally between a first end and a second end, a back head disposed at the first end of the casing for connection to a pressurized fluid source, a distributor disposed in the casing at the first end thereof proximate to the back head, and a drill bit extending longitudinally between a first end and a second end and having a bore extending from the first end toward the second end. The first end of the drill bit is disposed within the casing proximate the second end of the casing and the second end of the drill bit is disposed outside of the casing proximate the second end of the casing. The drill bit and the casing are longitudinally movable with respect to each other. A chamber within the casing is located between the distributor and the drill bit. A bearing extending longitudinally between a first end and a second end and having a bore extending therebetween is fixedly disposed within the casing proximate the second end of the casing. At least a portion of the first end of the drill bit is disposed within the bore of the bearing proximate the second end of the bearing. A piston extending longitudinally between a first end and second end and having a bore extending therebetween is located in the chamber for reciprocating longitudinal movement. The second end of the piston is configured to selectively enter the bore of the bearing through the first end of the bearing to impact the first end of the drill bit. The bores of the piston and the drill bit are in direct fluid communication only when the second end of the piston contacts the first end of the drill bit, and the piston includes no internal ports other than the bore.

BRIEF DESCRIPTION OF THE DRAWINGS

The foregoing summary, as well as the following detailed description of preferred embodiments of the invention, will be better understood when read in conjunction with the appended drawings. For the purpose of illustration, there is shown in the drawings an embodiment which is presently preferred. It should be understood, however, that the invention is not limited to the precise arrangements and instrumentalities shown.

DETAILED DESCRIPTION OF THE INVENTION

Figure 1:
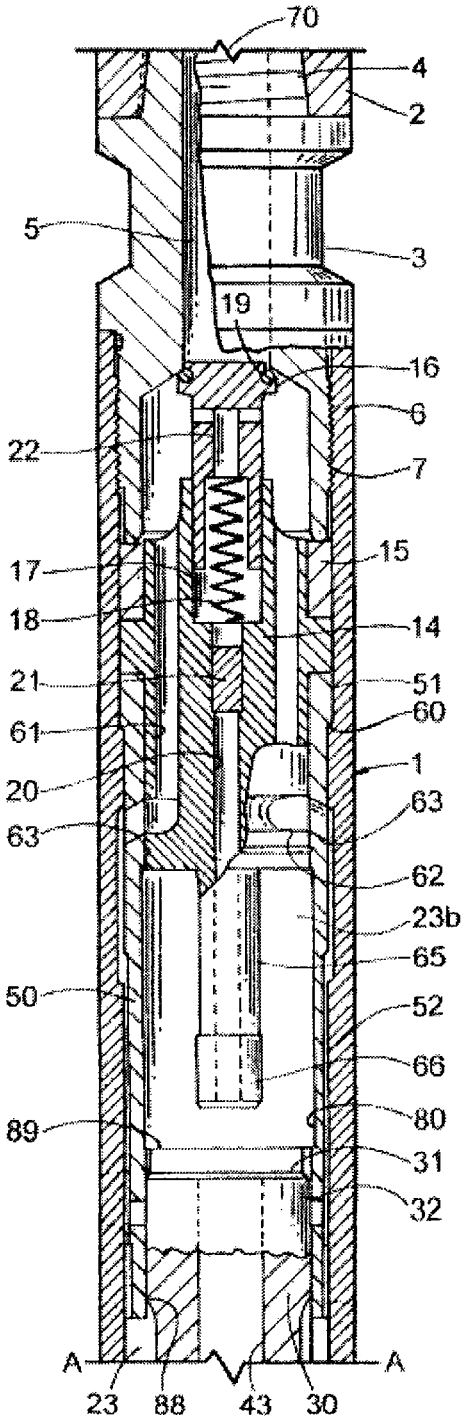
FIG. 1 is a longitudinal cross-sectional view of a rear part of a fluid actuated percussive impact tool in accordance with a preferred embodiment of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the fluid actuated percussive impact tool and designated parts thereof. The terminology includes the above-listed words, derivatives thereof, and words of similar import. Additionally, the words "a" and "an", as used in the claims and in the corresponding portions of the specification, mean "at least one."

Referring to the drawings, wherein like numerals indicate like elements throughout, there is shown in FIGS. 1-4, an improved fluid actuated percussive impact tool 1 adapted for down hole drilling. The drill 1 is adapted to be suspended in a hole using an appropriate drill string 2. The drill 1 is provided with a back head coupling 3 which couples the drill string 2 to the remainder of the drill body. The back head coupling 3 includes a mating threaded section 4 for connection to the drill string 2. A center bore 5 is provided through the back head coupling 3 for passing pressurized fluid from the drill string 2 to the remainder of the drill.

The impact tool or drill 1 includes a longitudinally extending casing 6 which is preferably threadedly engaged at one end using casing thread 7 to the back head coupling 3. The casing 6 is preferably symmetrically machined so that it can be reversed end-to-end to provide for increased life by reversing the casing 6 when one side becomes too worn.

A distributor 14 is disposed within the casing 6 in proximity to the back head coupling 3. The distributor 14 slides into the casing 6 when the back head coupling 3 is removed. A collar 15 serves to retain the distributor 14 in place. The distributor 14 is provided with a check valve 16 which serves to prevent reverse flow of pressurized fluid and/or foreign particulate matter back into the drill string 2. The check valve 16 is disposed within a bore 17 located within the distributor 14. A spring 18 biases the check valve 16 towards the closed position in contact with the central bore 5 of the back head coupling 3. An O-ring seal 19 is provided between the check valve 16 and the back head coupling 3. The check valve 16 is further provided with a T-shaped passageway 22 which provides access for pressurized fluids to the bore 17.

An axially bored passageway 20 is provided in the distributor 14 for directing the pressurized fluid directly through the distributor 14 to the remainder of the impact apparatus 1 in certain applications as described in more detail below. A series of longitudinal bore holes 61 are also provided in the distributor 14 which end in a circumferential undercut 62 adjacent to the lower end of the distributor 14.

The flow of pressurized fluid, such as air, through the passageway 20 in the distributor 14 is regulated by way of an orifice plug 21. In one embodiment, the orifice plug 21 is solid and no pressurized fluid flows through the axially bore passageway 20. However, in some types of rock or soil conditions, it is desirable to provide a continuous or increased purge of pressurized fluid through the impact tool 1. Accordingly, the plug 21 can be removed or provided with a calibrated drill bore in order to regulate the passage of pressurized fluid.

Figure 2:
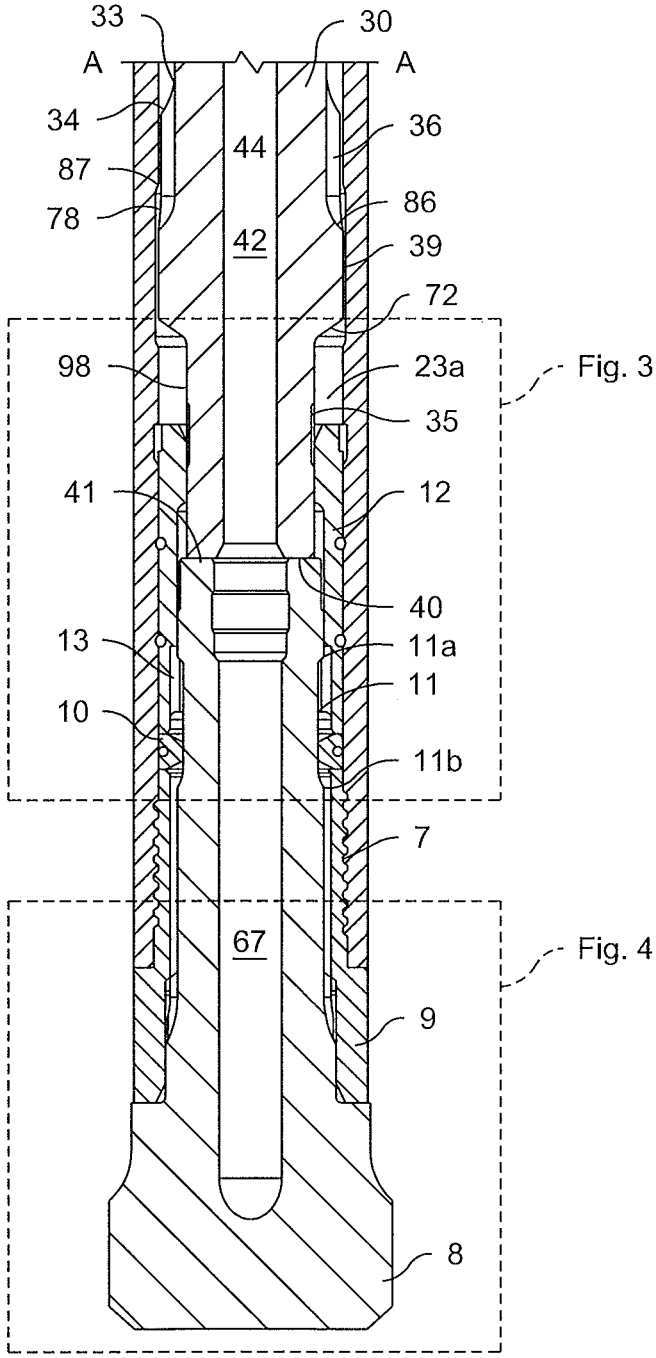
FIG. 2 is an enlarged longitudinal cross-sectional view of the forward part of the fluid actuated percussive impact tool of FIG. 1.

As shown in FIG. 2, an impact receiving device, such as a longitudinally extending percussive drill bit 8 is mounted at a second end of the casing 6. A first end of the drill bit 8 is disposed within the casing 6, and a second end of the drill bit is disposed outside of the casing 6 for impacting the surface (not shown) to be drilled. The drill bit 8 and the casing 6 are longitudinally movable with respect to one another between an extended position (FIGS. 3 and 4) wherein the second end of the drill bit 8 is furthest from the second end of the casing 6, and a retracted position (FIG. 2) wherein the second end of the drill bit 8 is directly adjacent the second end of the casing 6. The percussive drill bit 8 is coupled to the casing 6 by a supporting chuck 9. The supporting chuck 9 is threadedly and removably engaged with the casing 6 at its second end using a second casing thread 7 (i.e., a plurality of splines on an exterior surface of the chuck 9 mates with a plurality of splines on an interior surface of the casing). The percussive drill bit 8 is mounted for restricted axial movement within the chuck 9. The downward axial excursion of the drill bit 8 is limited by a split retaining ring 10, which rides in an annular groove 11 at the first end of the drill bit 8. The retaining ring 10 is located at the proximal end 11*a* of the groove 11 when the drill bit 8 is in the extended position (FIGS. 3 and 4) and at the distal end 11*b* of the groove 11 when the drill bit 8 is in the retracted position (FIG. 2).

Referring now to FIG. 1, a chamber 23 is located between the distributor 14 and the impact receiving device, which is preferably the drill bit 8. A cylindrical sleeve 50 is located within the casing 6 in proximity to the distributor 14. The cylinder sleeve 50 is slidably disposed within the casing 6 when the distributor 14, collar 15 and the back head coupling 3 are removed. Axial movement in the casing 6 is prevented by way of an increased diameter portion or boss 51 which contacts a ridge 60 in the casing 6. The cylindrical sleeve 50 includes a plurality of ports 63. One side of the distributor 14 is seated within the cylindrical sleeve 50 such that the undercut 62 is aligned with the ports 63. A first pressurized fluid passageway 52 is located between the cylindrical sleeve 50 and the casing 6. The passageway 52 may be annular or may be formed by annular segments between the sleeve 50 and the casing 6. Pressurized fluid can pass through the longitudinal bore holes 61 in the distributor 14 to undercut 62 adjacent to the lower end of the distributor 14, through the ports 63 in the cylindrical sleeve 50, and into the first passageway 52.

Referring now to FIG. 2, a longitudinally extending bearing 12 having a central bore 13 is fixedly disposed within the casing 6 proximate the second end thereof. A second end of the bearing 12 is adjacent the split retaining ring 10 in the chamber 23. At least a portion of the first end of the drill bit 8 is disposed within the bore 13 proximate the second end of the bearing 12 for axial movement therein.

Figure 3:
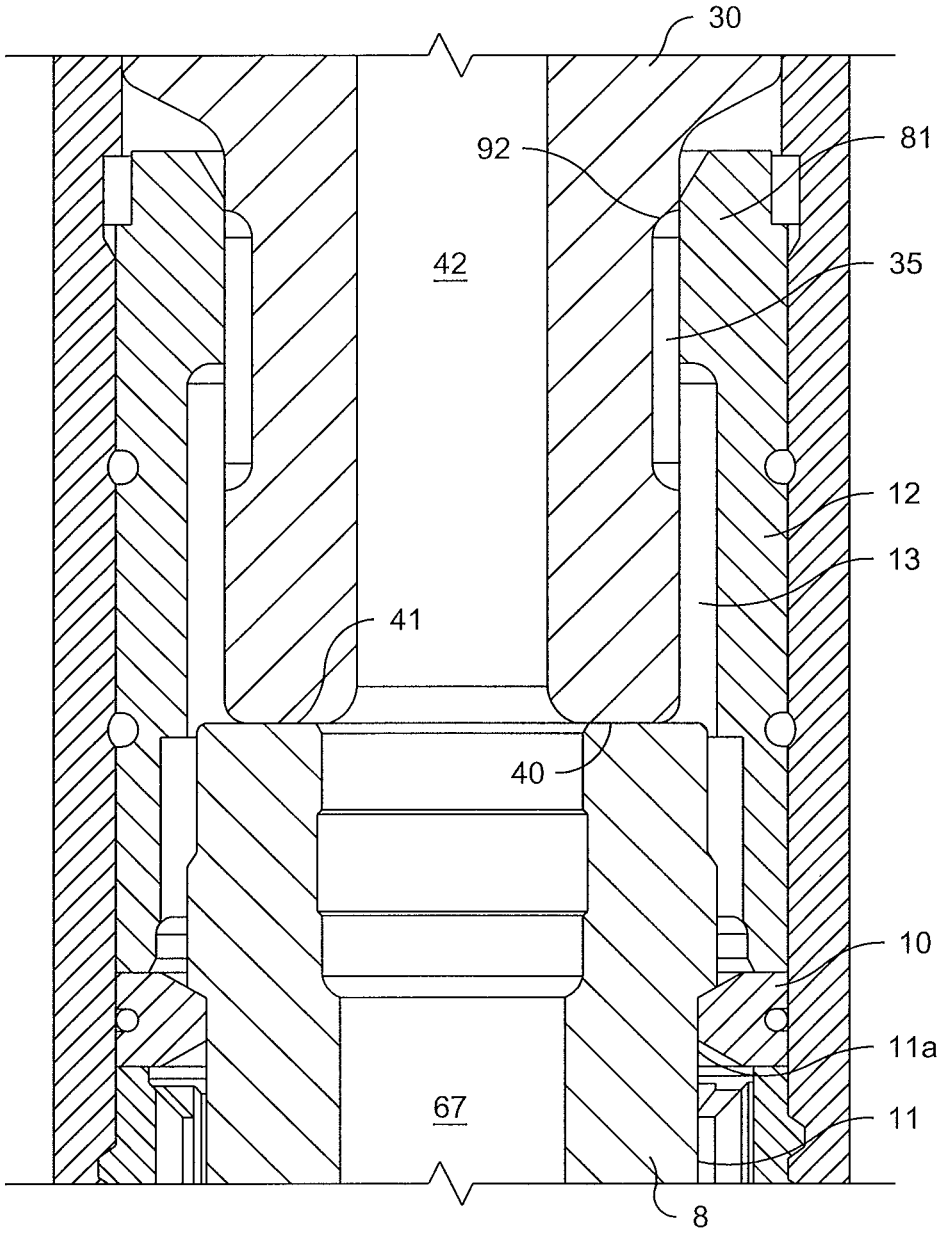
FIG. 3 is a greatly enlarged fragmentary view of a portion of the fluid actuated percussive impact tool of FIG. 2 showing the drill in the non-operative position.
Figure 4:
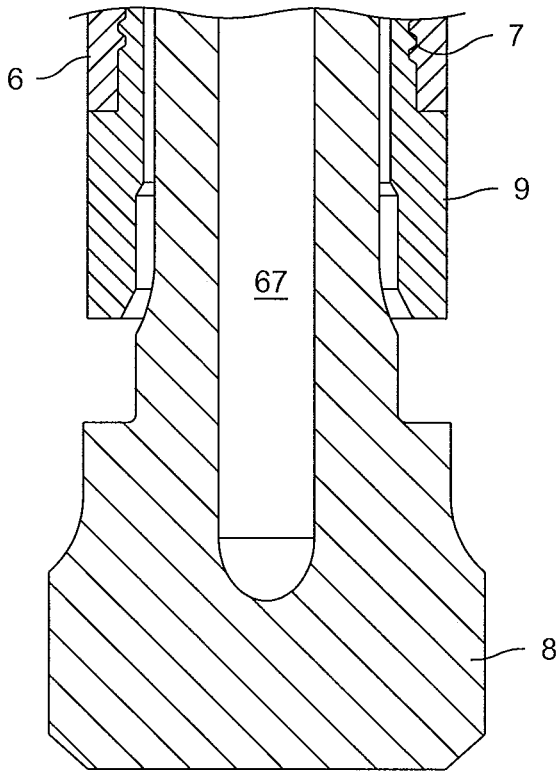
FIG. 4 is a greatly enlarged fragmentary view of a portion of the fluid actuated percussive impact tool of FIG. 2 showing the drill, specifically the drill bit, in the non-operative position.

Still with reference to FIGS. 1-3, a piston 30 is located within the casing 6 and extends longitudinally between a first end 31 and a second end 40. The second end 40 of the piston 30 preferably includes a hammer surface facing the impact receiving device or drill bit 8 and a first sealing surface 39 that is in sliding contact with a portion of the casing 6 when the piston 30 is in the extended position. The first end 31 of the piston 30 includes a second sealing surface 32 which sealingly engages the cylinder sleeve 50 when the piston 30 is in the lower portion of its travel. The chamber 23 includes a lower chamber portion 23*a* between the piston 30 and the impact receiving device 8 and an upper chamber portion 23*b* between the first end 31 of the piston 30 and the distributor 14.

Axially extending grooves are located on at least one of the piston 30, the cylinder sleeve 50, and the casing 6 in the chamber 23 for alternately supplying pressurized fluid to the upper and lower chamber portions 23*a*, 23*b*. The piston 30 preferably includes a reduced diameter portion 33 adjacent to the second sealing surface 32 and between the first and second sealing surfaces 32, 39 which directs pressurized fluid to the upper chamber portion 23*b* when the piston 30 is in the upper part of its travel. Preferably, axial porting grooves 36 are provided on the large diameter portion of the piston 30 starting an appreciable distance from the second end 40 which end at a shoulder 34 adjacent to the reduced diameter portion 33 of the piston 30. The axial grooves 36 provide a passageway for pressurized fluid to move axially along the outside portion of the piston 30 when the piston 30 is in the lower portion of its travel. The first and second sealing surfaces 39, 32 serve as seals against the flow of pressurized fluid when contact with the internal surfaces of the cylinder sleeve 50 or the casing 6 is made.

The second end 40 of the piston 30 is used for imparting force on an anvil 41 of the first end of the impact receiving device or drill bit 8. The second end 40 of the piston 30 is configured to selectively enter the bore 13 of the bearing 12 through the first end thereof to impact the anvil 41. The piston 30 includes an axial bore 42 with an internal sealing surface 43 at its upper end and internal sealing surface 44 at its lower end. The piston 30 is preferably a "solid piston" (i.e., includes no internal ports other than the bore 42). The distributor 14 is provided with an exhaust rod 65 which has an enlarged head and sealing surfaces 66. When the piston 30 has moved sufficiently towards the distributor 14 to engage the exhaust rod 65, the enlarged head and sealing surfaces 66 and the internal sealing surface 43 cooperate to close off the axial bore 42 from any pressurized fluid that may be supplied to the upper chamber portion 23*b*.

The respective bores 42, 67 of the piston 30 and the percussive drill bit 8 are in direct fluid communication only when the second end 40 of the piston 30 contacts the anvil 41 of the first end of the percussive drill bit 8. Circumferential grooves or undercuts 78, 80 in the casing 6 and the cylinder sleeve 50 cooperate with the first and second sealing surfaces 39, 32 of the piston 30 depending on its position to either pass or prevent the flow of pressurized fluid to the upper and lower chamber portions 23*a*, 23*b* formed at the opposite ends of the piston 30. The axially extending grooves located on at least one of the piston 30, the cylinder sleeve 50 and the casing 6 in the chamber 23 alternately supply pressurized fluid to the upper and lower chamber portions 23*a*, 23*b*, and the bores 42, 67 in fluid communication with the chamber 23 selectively exhaust the pressurized fluid from the upper and lower chamber portions 23*a*, 23*b* to thereby reciprocate the piston 30 between the extended position, shown in FIG. 3 and the retracted position (FIGS. 1-2) wherein the first end 31 is in proximity to the distributor 14.

Preferably, 250-350 psi fluid, such as air, enters the drill at inlet 70 in the back head coupling 3 from the drill string 2. The fluid pressure forces the check valve 16 to move forward against the spring 18 which holds it on its seat when no fluid pressure is applied to the drill 1. The fluid passes around the check valve 16 through the distributor 14 via the longitudinal bores 61, to the undercut 62 in the distributor 14 where it passes through the ports 63 in the cylinder sleeve 50 into the first passageway 52 between the outside of the cylinder sleeve 50 and the inside of the casing 6. From here, the air moves into the chamber 23 between the reduced diameter portion 33 of the piston 30 and the casing 6. This provides an air reservoir space because there is always fluid pressure in the space between the reduced diameter portion 33 of the piston 30 and it is from this space that the pressurized fluid passes either to the lower chamber portion 23*a* or the upper chamber portion 23*b*.

When the piston 30 is in the lower portion of its travel, air passes into the lower chamber portion 23*a* exerting a force on a first lifting surface 72 of the piston 30, as well as on the second end 40 of the piston 30. This drives the piston 30 upward as air continues to feed into the lower chamber portion 23*a* until a groove opening timing location defined by edge 86, located at the intersection of the sealing surface 39 and the axial grooves 36, passes shoulder 87 of the groove or undercut 78 in the inside of the casing 6. The first sealing surface 39 is then in sealing relation with the inside of the casing 6, shutting off air to the lower chamber portion 23*a*. The piston 30 continues to move upwards by virtue of its momentum and the expansion of air in the lower chamber portion 23*a*. As the piston 30 rises, pressurized air in the lower chamber portion 23*a* exhausts into the drill bit 8 and into the bore 67.

As the piston 30 rises, the upper chamber portion 23*b* is sealed off as the sealing surface 43 of the piston 30 engages the lower end of the enlarged head and sealing surfaces 66 of the exhaust rod 65 of the distributor 14. As the second sealing surface 32 adjacent to the first end 31 of the piston 30 passes beyond the shoulder 89 of undercut 80 inside the cylinder sleeve 50, pressurized air passes into the upper chamber portion 23*a*. The pressurized air first stops the piston 30 in its upward travel and then reverses the piston 30 pushing downward at increasing velocity. Flow of pressurized fluid to the upper chamber portion 23*b* is shut off as the lower edge 88 of the second sealing surface passes the shoulder 89. The piston 30 continues to accelerate downwardly until the first sealing surface 39 of the piston 30 losses contact with the shoulder 87 of the interior surface 30 of the casing 6 at which point air re-enters the lower chamber portion 23*a*. However, the momentum and expanding pressurized fluid in the upper chamber portion 23*b* force the piston 30 downwardly to impact against the impact receiving device or drill bit 8. The piston 30 rebounds somewhat after impact, and this plus the air re-entering the lower chamber portion 23*a* acting on the first lifting surface 72 and on the second end 40 of the piston 30 starts the next cycle.

In the known devices as exemplified by U.S. Pat. No. 4,084,646, the piston weighs 45 to 50 pounds and reciprocates at a frequency in the range of 1,500 to 1,800 blows per minute on the impact receiving device or drill bit 8. However, the performance of the fluid actuated percussive impact tool 1 is improved by including, in the piston 30, a reduced diameter neck 98 adjacent to the second end 40 of the piston 30. The reduced diameter neck 98 forms the first lifting surface 72 and at the same time enlarges the remaining area of the lower chamber portion 23*a* when the piston 30 is in the first position, shown in FIG. 1, as well as reduces the weight of the piston by approximately one pound.

Referring now to FIGS. 1 and 3, when the pressure is turned off, the piston 30 and the percussive drill bit 8 drop down into the extended position by force of gravity. At least one groove 35 is formed in the exterior surface of the piston 30 proximate the second end 40 thereof, and extends partially along the piston 30 toward the first end 31. The at least one groove 35 preferably extends longitudinally. Conventional pistons do not include grooves such as those shown in FIG. 3, but instead are narrower at the portion that impacts the drill bit. The at least one groove 35 in the present invention allows for the piston 30 to be larger proximate the second end 40, and therefore more robust for surviving the rigors of the repeated impacts.

The drill 1 includes a sealed position when the drill bit 8 is in the extended position (FIG. 3). A water seal is formed between an interior surface of the bearing 12 and a portion of the exterior surface of the piston 30 between the first end 31 of the piston and the first end of the groove 35. More preferably, the bearing 12 includes a flange 81 proximate the first end thereof that projects into the bore 13. Further the at least one groove 35 at the first end preferably forms a shoulder 92 projecting radially outwardly from the piston 30. At least a portion of the water seal is formed between the shoulder 92 and the flange 81 of the bearing 12.

From the foregoing, it can be seen that embodiments of the present invention comprise a fluid actuated percussive impact tool. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A fluid-actuated percussive impact tool comprising:

(a) a casing extending longitudinally between a first end and a second end;

(b) a back head disposed at the first end of the casing for connection to a pressurized fluid source;

(c) a distributor disposed in the casing at the first end thereof proximate to the back head;

(d) a drill bit extending longitudinally between a first end and a second end, the first end of the drill bit being disposed within the casing proximate the second end of the casing and the second end of the drill bit being disposed outside of the casing proximate the second end of the casing, the drill bit and the casing being longitudinally movable with respect to each other between an extended position wherein the second end of the drill bit is furthest from the casing and a retracted position wherein the second end of the drill bit is directly adjacent the second end of the casing;

(e) a chamber within the casing located between the distributor and the drill bit;

(f) a bearing extending longitudinally between a first end and a second end and having a bore extending therebetween, the bearing being fixedly disposed within the casing proximate the second end of the casing, at least a portion of the first end of the drill bit being disposed within the bore proximate the second end of the bearing;

(g) a piston extending longitudinally between a first end and second end and located in the chamber for reciprocating longitudinal movement, the second end of the piston being configured to selectively enter the bore of the bearing through the first end of the bearing to impact the first end, of the drill bit, at least one groove having a first end and a second end being formed in an exterior surface of the piston proximate the second end of the piston and extending partially along the piston toward the first end thereof, the tool having a sealed position when the drill bit is in the extended position and the second end of the piston contacts the first end of the drill bit, wherein a water seal is formed between an interior surface of the bearing and a portion of the exterior surface of the piston between the first end of the piston and the first end of the at least one groove.

2. The tool of claim 1, wherein the bearing includes a flange proximate the first end thereof that projects into the bore, the water seal being formed between the flange of the bearing and the exterior surface of the piston between the first end of the piston and the first end of the at least one groove.

3. The tool of claim 1, wherein the first end of the at least one groove forms a shoulder projecting radially outwardly from the piston, at least a portion of the water seal being formed between the interior surface of the bearing and the shoulder of the at least one groove.

4. The tool of claim 1, wherein the at least one groove extends longitudinally.

5. The tool of claim 1, wherein the drill bit is movably disposed within a chuck configured for attachment to the second end of the casing, the chuck and drill bit being removable from the casing.

6. A fluid-actuated percussive impact tool comprising:

(a) a casing extending longitudinally between a first end and a second end;

(b) a back head disposed at the first end of the casing for connection to a pressurized fluid source;

(c) a distributor disposed in the casing at the first end thereof proximate to the back head;

(d) a drill bit extending longitudinally between a first end and a second end and having a bore extending from the first end toward the second end, the first end of the drill bit being disposed within the casing proximate the second end of the casing and the second end of the drill bit being disposed outside of the casing proximate the second end of the casing, the drill bit and the casing being longitudinally movable with respect to each other;

(e) a chamber within the casing located between the distributor and the drill bit;

(f) a bearing extending longitudinally between a first end and a second end and having a bore extending therebetween, the bearing being fixedly disposed within the casing proximate the second end of the casing, at least a portion of the first end of the drill bit being disposed within the bore of the bearing proximate the second end of the bearing;

(g) a piston extending longitudinally between a first end and second end and having a bore extending therebetween, the piston being located in the chamber for reciprocating longitudinal movement, the second end of the piston being configured to selectively enter the bore of the bearing through the first end of the bearing to impact the first end of the drill bit, wherein the bores of the piston and the drill bit are in direct fluid communication only when the second end of the piston contacts the first end of the drill bit, and the piston includes no internal ports other than the bore, and wherein at least a portion of the piston is configured to contact the casing between the back head and the bearing when the second end of the piston has entered the bore of the bearing.

7. The tool of claim 6, wherein the drill bit is movably disposed within a chuck configured for attachment to the casing, the chuck and drill bit being removable from the casing.

8. The tool of claim 7, wherein an exterior surface of the chuck includes a plurality of splines configured to threadably mate with a plurality of splines on an interior surface of the casing.

9. The tool of claim 7, further comprising a split ring disposed in the casing between the bearing and the chuck.

* * * * *